US012325544B2

(12) United States Patent
Kim

(10) Patent No.: US 12,325,544 B2
(45) Date of Patent: Jun. 10, 2025

(54) COVER ATTACHMENT UNIT FOR BLISTER PACK AND BLISTER PACKING APPARATUS FOR DRUGS, COMPRISING SAME

(71) Applicant: CRETEM CO., LTD., Anyang-si (KR)

(72) Inventor: Hoyeon Kim, Anyang-si (KR)

(73) Assignee: CRETEM CO., LTD., Anyang-si (KR)

( * ) Notice: Subject to any disclaimer, the term of this patent is extended or adjusted under 35 U.S.C. 154(b) by 74 days.

(21) Appl. No.: 18/284,463

(22) PCT Filed: Mar. 28, 2022

(86) PCT No.: PCT/KR2022/004324
§ 371 (c)(1),
(2) Date: Sep. 27, 2023

(87) PCT Pub. No.: WO2022/211415
PCT Pub. Date: Oct. 6, 2022

(65) Prior Publication Data

US 2024/0166388 A1 May 23, 2024

(30) Foreign Application Priority Data

Mar. 29, 2021 (KR) ..... 10-2021-0040712

(51) Int. Cl.
*B65B 11/52* (2006.01)
*B65B 5/10* (2006.01)
(Continued)

(52) U.S. Cl.
CPC ..... *B65B 11/52* (2013.01); *B65B 5/103* (2013.01); *B65B 35/12* (2013.01); *B65B 41/16* (2013.01);
(Continued)

(58) Field of Classification Search
CPC ..... B65B 11/52; B65B 2230/02; B65B 35/12; B65B 41/16; B65B 5/103; B65B 51/02;
(Continued)

(56) References Cited

U.S. PATENT DOCUMENTS 3,512,332 A * 5/1970 Klein ..... B29C 51/162 425/290
6,925,774 B2 * 8/2005 Peterson ..... B65B 35/04 53/247
(Continued)

FOREIGN PATENT DOCUMENTS

JP 2012153434 A * 8/2012
KR 10-0343788 B1 7/2002
(Continued)

OTHER PUBLICATIONS

Machine translation of Yoshioka (JP-2012153434-A) (Year: 2012).*
(Continued)

*Primary Examiner* — Anna K Kinsaul
*Assistant Examiner* — Himchan Song
(74) *Attorney, Agent, or Firm* — Paratus Law Group, PLLC

(57) ABSTRACT

A cover attaching unit for a blister pack, includes: a cover supply roller configured to supply a release film having the cover detachably attached thereto so that the lower surface of the cover is not exposed; a release film collecting roller configured to wind and collect the release film, with the cover separated therefrom; a cover suction plate comprising a suction surface configured to suck the cover; and a cover separating plate configured to be movable between a first position not overlapping the cover suction plate and a second position overlapping the cover suction plate and
(Continued)

comprising a wedge to bend a travel direction of the release film at an acute angle so that the cover is separated from the release film.

12 Claims, 9 Drawing Sheets

(51) Int. Cl.
*B65B 35/12* (2006.01)
*B65B 41/16* (2006.01)
*B65B 61/02* (2006.01)
*B65B 61/28* (2006.01)

(52) U.S. Cl.
CPC ..... *B65B 61/025* (2013.01); *B65B 61/28* (2013.01); *B65B 2230/02* (2013.01)

(58) Field of Classification Search
CPC ..... B65B 51/14; B65B 61/025; B65B 61/26; B65B 61/28; B65B 7/2871
See application file for complete search history.

(56) References Cited

U.S. PATENT DOCUMENTS

2004/0000354 A1 1/2004 Peterson
2004/0093835 A1* 5/2004 Siegel ..... B65D 75/323 53/558
2008/0271417 A1* 11/2008 Drost ..... B65B 5/105 53/443
2015/0101283 A1* 4/2015 Fuhrmann ..... B65B 5/103 53/171
2020/0333256 A1* 10/2020 Taguchi ..... G01N 21/9508
2021/0199594 A1* 7/2021 Taguchi ..... B65B 1/02
2022/0089309 A1* 3/2022 Takada ..... B65B 1/04
2023/0053278 A1* 2/2023 Finch ..... A61J 7/0084
2023/0118029 A1* 4/2023 Clarke ..... B65B 7/28 206/538

FOREIGN PATENT DOCUMENTS

KR 10-0849735 B1 8/2008
KR 10-2017-0068285 A 6/2017
KR 20180043215 A * 3/2018
KR 10-2018-0043215 A 4/2018

OTHER PUBLICATIONS

Machine translation of Lim (KR-20180043215-A) (Year: 2018).*
International Search Report for PCT/KR2022/004324 mailed Jun. 30, 2022 from Korean Intellectual Property Office.
Korean Office Action for related KR Application No. 10-2021-0040712 mailed Jul. 19, 2022 from Korean Intellectual Property Office.

* cited by examiner

COVER ATTACHMENT UNIT FOR BLISTER PACK AND BLISTER PACKING APPARATUS FOR DRUGS, COMPRISING SAME

CROSS-REFERENCE TO PRIOR APPLICATIONS

This Application is a National Stage Patent Application of PCT International Application No. PCT/KR2022/004324 (filed on Mar. 28, 2022), which claims priority to Korean Patent Application No. 10-2021-0040712 (filed on Mar. 29, 2021), which are all hereby incorporated by reference in their entirety.

BACKGROUND

The present invention relates to a cover attaching unit for a blister pack that attaches a cover to a blister sheet for drug packaging, which is filled with drugs according to a prescription, and a blister packing apparatus for drugs including the same.

Drugs prepared in hospitals or pharmacies according to prescriptions are packaged in unit doses in plastic bags, or are packaged and sealed in a blister pack. The blister pack includes a blister sheet including a plurality of drug pockets arranged in a matrix and a cover attached to an upper surface of the blister sheet in order to hermetically seal the plurality of drug pockets. A method of packaging and sealing drugs using a blister pack is increasingly used because the method has effects of preventing theft, loss, or abuse of drugs and assisting a user in correctly taking drugs when a drug-taking procedure is complicated, for example, when drugs to be taken after lunch and drugs to be taken after dinner are different from each other.

In order to improve efficiency of packaging drugs in a blister pack according to a prescription, a blister packing apparatus for drugs capable of automatically dispensing drugs of unit doses and packaging the same in a blister pack is required. The blister packing apparatus needs to include a cover attaching unit for a blister pack that automatically performs a cover attachment process of attaching a cover to a blister sheet, with a plurality of drug pockets filled with drugs, to close the drug pockets.

Related Art Document: Korean Patent Registration No. 10-0343788

SUMMARY

The present invention provides a cover attaching unit for a blister pack that automatically attaches a cover to a blister sheet filled with drugs to completely form a blister pack, and a blister packing apparatus for drugs including the same.

The present invention provides a cover attaching unit for a blister pack. The cover attaching unit for a blister pack attaches a cover having an adhesive applied to a lower surface thereof to a blister sheet including a plurality of drug pockets to close the plurality of drug pockets. The cover attaching unit for a blister pack includes a cover supply roller, a release film collecting roller, a cover suction plate, and a cover separating plate. The cover supply roller supplies a release film having the cover detachably attached thereto so that the lower surface of the cover is not exposed. The release film collecting roller winds and collects the release film, with the cover separated therefrom. The cover suction plate includes a suction surface configured to suck the cover. The cover separating plate is movable between a first position not overlapping the cover suction plate and a second position overlapping the cover suction plate, and includes a wedge to bend a travel direction of the release film at an acute angle so that the cover is separated from the release film. In this case, after the cover separating plate is located at the second position and the cover attached to the release film is located below the cover suction plate so as to be aligned with the cover suction plate, the suction surface of the cover suction plate sucks the cover. In addition, the cover separating plate moves to the first position, the release film collecting roller winds and collects the release film to separate the cover from the release film, the blister sheet moves to a position below the cover suction plate, and the cover suction plate sucking the cover moves down to attach the lower surface of the cover to the blister sheet.

In order to prevent tension of the release film from becoming excessive when the cover separating plate moves from the first position to the second position, the release film collecting roller may rotate in a direction opposite a direction in which the release film is wound to be collected, and the cover supply roller may not rotate.

After the cover separating plate is located at the second position, the release film collecting roller may rotate in the direction in which the release film is wound to be collected, the cover supply roller may rotate in a direction in which the release film is supplied, and the cover attached to the release film may move to a position below the cover suction plate so as to be aligned with the cover suction plate.

The cover attaching unit for a blister pack of the present invention may further include a printer configured to print letters or pictures on an upper surface of the cover. The printer may perform printing on the cover while the cover attached to the release film is moved to a position below the cover suction plate so as to be aligned with the cover suction plate by rotation of the cover supply roller in the direction in which the release film is supplied.

The cover attaching unit for a blister pack of the present invention may further include a cover separating plate locker. The cover separating plate locker blocks the cover separating plate so that the cover separating plate located at the second position is not moved toward the first position by tension of the release film. The cover separating plate locker may be movable between a locking position at which the cover separating plate locker blocks the cover separating plate to fix the position of the cover separating plate and an unlocking position at which the cover separating plate locker does not block the cover separating plate.

The cover attaching unit for a blister pack of the present invention may further include a separating plate driver configured to move the cover separating plate. The separating plate driver may move by itself in a direction parallel to a direction in which the cover separating plate is moved in order to increase a distance between the first position and the second position.

After the lower surface of the cover is attached to the blister sheet, the cover suction plate may stop sucking the cover and may move up. The cover attaching unit for a blister pack of the present invention may further include a cover pressing roller configured to press the cover attached to the blister sheet toward the blister sheet so that the cover is adhesively fixed to the blister sheet.

In addition, a blister packing apparatus for drugs in accordance with another aspect of the present invention includes the above-described cover attaching unit for a blister pack, a drug dispensing unit, a drug supply unit, a blister sheet supply unit, and a blister sheet feeding unit.

The drug dispensing unit dispenses and drops drugs prepared in a unit dose according to a prescription to each of a plurality of drug pockets formed in a blister sheet. The drug supply unit is disposed above the drug dispensing unit to drop drugs to the drug dispensing unit. The blister sheet supply unit drops and supplies a blister sheet having no drugs in the plurality of drug pockets one by one.

The cover attaching unit for a blister pack attaches a cover to the blister sheet, with the plurality of drug pockets filled with the drugs, to form a blister pack having the plurality of closed drug pockets. The blister sheet feeding unit feeds the blister sheet falling down from the blister sheet supply unit to the drug dispensing unit, and feeds the blister sheet, with the plurality of drug pockets filled with the drugs, from the drug dispensing unit to the cover attaching unit.

The blister sheet may move from the drug dispensing unit to a position below the cover suction plate before the cover suction plate moves down in a state of sucking the cover.

The blister packing apparatus for drugs of the present invention may further include a blister pack discharge conveyor configured to discharge the blister pack outside of the blister packing apparatus for drugs.

The blister sheet feeding unit may include a blister sheet tray, a tray driver, and a pair of guide rails. The blister sheet is seated on the blister sheet tray. The tray driver moves the blister sheet tray between the blister sheet supply unit, the drug dispensing unit, and the cover attaching unit for a blister pack. The pair of guide rails extends parallel in order to guide movement of the blister sheet tray. In this case, the blister pack discharge conveyor is located between the pair of guide rails at a position below the cover suction plate. The cover suction plate sucks the blister pack and moves up so that the blister pack is lifted up so as to be separated from the blister sheet tray, the blister sheet tray, with the blister pack separated therefrom, moves to the blister sheet supply unit, the cover suction plate moves down again to place the blister pack on the blister pack discharge conveyor, the cover suction plate stops sucking and moves up again, and the blister pack discharge conveyor moves the blister pack.

The drug dispensing unit may be disposed on the left side or the right side of the cover suction plate, and the cover supply roller and the release film collecting roller may be disposed behind the cover suction plate. When the cover separating plate is located at the first position, the cover separating plate may be located behind the cover suction plate, and when the cover separating plate is located at the second position, the cover separating plate may be located below the cover suction plate.

The cover attaching unit for a blister pack according to the present invention automatically attaches a cover to a blister sheet into which drugs are introduced according to a prescription, thereby completely forming a blister pack containing the drugs. Therefore, the efficiency and reliability of an automatic drug packaging process using the blister sheet are improved.

In addition, since the cover attaching unit for a blister pack according to the present invention includes a cover separating plate configured to be movable to a position overlapping a cover suction plate, the cover is sucked by the cover suction plate in a state of being accurately spread and aligned with the cover suction plate. Therefore, no error or quality defect occurs in the cover attaching process.

The cover attaching unit for a blister pack according to an exemplary embodiment of the present invention, which is provided with a printer, is capable of printing information for identifying drugs and a recipient of the drugs and information about a drug-taking procedure on the cover using the printer, thereby preventing the occurrence of errors in transferring the blister pack and assisting in correct dosing of drugs.

DETAILED DESCRIPTION

Hereinafter, a cover attaching unit for a blister pack and a blister packing apparatus for drugs including the same according to embodiments of the present invention will be described in detail with reference to the accompanying drawings. Terms used in this specification are used to appropriately describe exemplary embodiments of the present invention, and thus may be changed in accordance with the intention of users or operators, or usual practice in the art to which the present invention pertains. Therefore, the definitions of these terms should be determined based on the total content of this specification.

Figure 1:
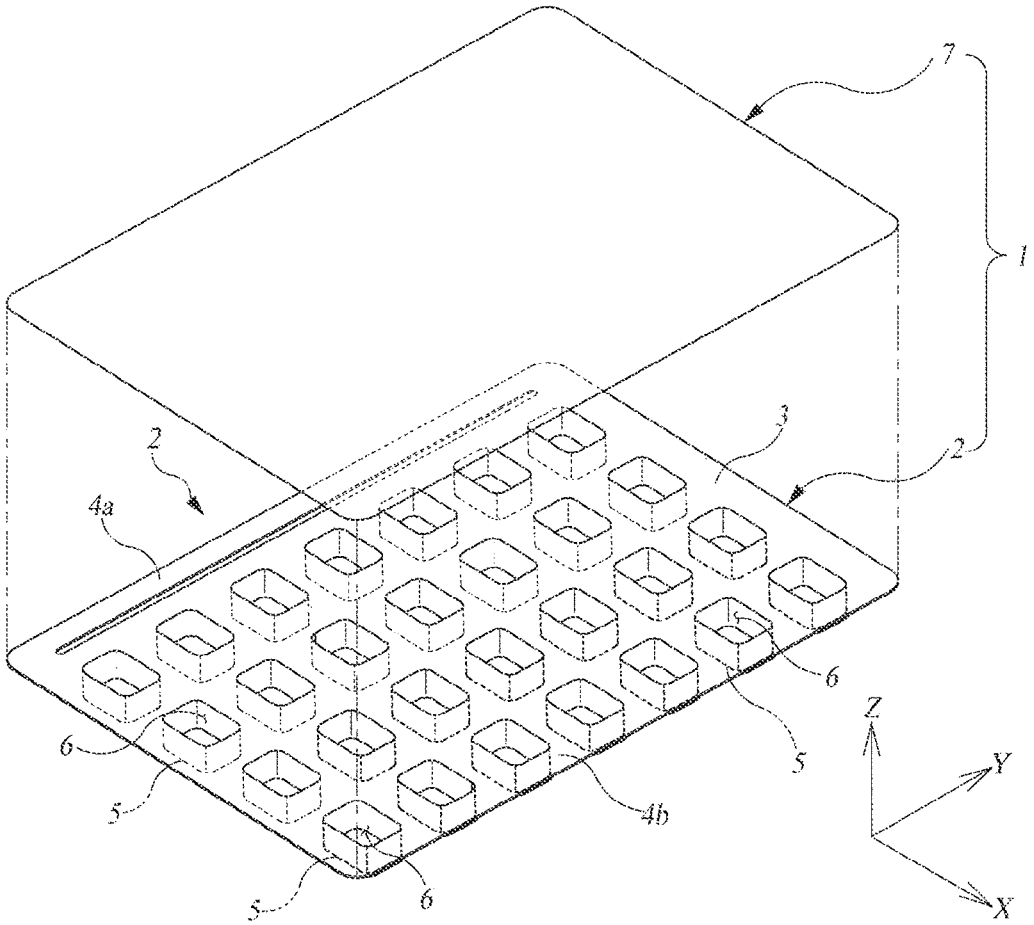
FIG. 1 is a perspective view showing an example of a blister pack for drug packaging.

FIG. 1 is a perspective view showing an example of a blister pack for drug packaging. Referring to FIG. 1, a blister sheet 2 for drug packaging used to package drugs prepared according to a prescription includes a flat portion 3 and a plurality of pocket portions 5 convexly protruding downward from the flat portion 3. The plurality of pocket portions 5 is formed so as to be spaced apart from each other. A plurality of drug pockets 6 is formed so as to be open upward so that falling drugs are received in unit doses in the plurality of pocket portions 5. The plurality of drug pockets 6 is arranged in a matrix. In the illustrated blister sheet 2, the drug pockets 6 are arranged in 7 rows and 4 columns so as to be filled with a maximum of one week's supply of prepared drugs.

When the plurality of drug pockets 6 is filled with drugs, a sheet-type cover 7 is attached to an upper surface of the flat portion 3 of the blister sheet 2 in order to hermetically seal the plurality of drug pockets 6. A blister pack 1, which accommodates and seals the drugs in a state of separating the drugs in unit doses, includes the blister sheet 2 in which drugs are accommodated and the cover 7 attached to the blister sheet 2. The lower surface of the cover 7 that is attached to the upper surface of the flat portion 3 of the blister sheet 2 is an adhesive surface to which an adhesive is applied. A user may press and tear the cover 7 using his/her fingers or a tool to pull the drugs from the drug pockets 6 and take the same.

Figure 2:
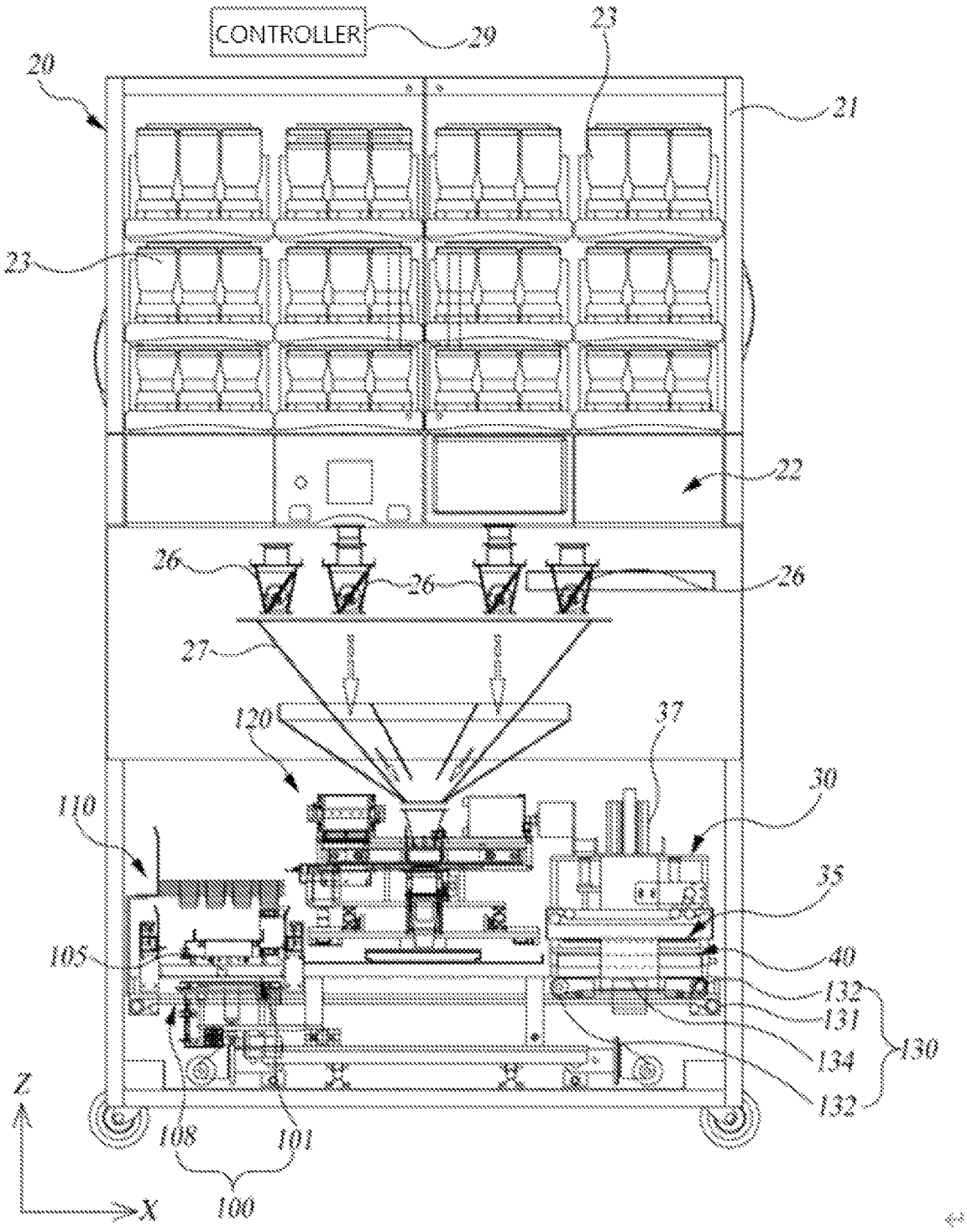
FIG. 2 is a front view of a blister packing apparatus for drugs according to an embodiment of the present invention.

FIG. 2 is a front view of a blister packing apparatus for drugs according to an embodiment of the present invention. Referring to FIGS. 1 and 2 together, a blister packing apparatus 20 for drugs is an apparatus that automatically performs processes of dispensing drugs prepared in unit doses to the plurality of drug pockets 6 of the blister sheet 2 (refer to FIG. 1) and hermetically sealing the blister sheet 2 using the cover 7 to form the blister pack 1, and is mainly provided in large hospitals or pharmacies.

The blister packing apparatus 20 for drugs includes a cabinet-type housing 21, and includes a drug supply unit 22, a drug dispensing unit 120, a blister sheet supply unit 110, a cover attaching unit 30 for a blister pack, a blister sheet feeding unit 100, and a blister pack discharge conveyor 130, which are provided in the housing 21.

The drug supply unit 22 is located in an upper portion of the housing 21. In addition, the drug dispensing unit 120, the blister sheet supply unit 110, the cover attaching unit 30 for a blister pack, the blister sheet feeding unit 100, and the blister pack discharge conveyor 130 are located below the drug supply unit 22. In addition, the blister packing apparatus 20 for drugs further includes a controller 29 configured to control operation of the drug supply unit 22, the drug dispensing unit 120, the blister sheet supply unit 110, the cover attaching unit 30 for a blister pack, the blister sheet feeding unit 100, and the blister pack discharge conveyor 130.

The drug supply unit 22 includes a plurality of drug cassettes 23 and hoppers 26 and 27. The plurality of drug cassettes 23 accommodates different kinds of drugs. The hoppers 26 and 27 collect the drugs discharged from the drug cassettes 23 and guide the collected drugs to be sequentially discharged downward. In detail, specific drugs corresponding to a prescription input through a server or a user interface are discharged from the drug cassettes 23 storing the same, and fall down through a drug falling passage (not shown). The drugs are collected in a plurality of intermediate hoppers 26 disposed under the plurality of drug cassettes 23, fall down therefrom in an adjusted falling order, and sequentially fall down in unit doses through a final hopper 27 according to the prescription.

The drug dispensing unit 120 receives the drugs falling down from the final hopper 27 of the drug supply unit 22, inspects whether the received drugs are drugs prepared in a unit dose according to the prescription, and dispenses and drops the drugs of a unit dose to each of the plurality of drug pockets 6 of the blister sheet 2. The blister sheet supply unit 110 is disposed on the left side of the drug dispensing unit 120, and drops and supplies a blister sheet 2 having no drugs in the plurality of drug pockets 6 one by one. The cover attaching unit 30 for a blister pack is disposed on the right side of the drug dispensing unit 120, and attaches the cover 7 to the upper surface of the flat portion 3 of the blister sheet 2, with the plurality of drug pockets 6 filled with the drugs, to form the blister pack 1 having the plurality of closed drug pockets 6. However, unlike what is illustrated in FIG. 2, the blister sheet supply unit 110 may be disposed on the right side of the drug dispensing unit 120, and the cover attaching unit 30 for a blister pack may be disposed on the left side of the drug dispensing unit 120.

The blister sheet feeding unit 100 feeds the blister sheet 2 falling down from the blister sheet supply unit 110 to the drug dispensing unit 120. In addition, the blister sheet feeding unit 100 feeds the blister sheet 2, with the plurality of drug pockets 6 filled with the drugs by the drug dispensing unit 120, from the drug dispensing unit 120 to the cover attaching unit 30 for a blister pack.

Figure 4:
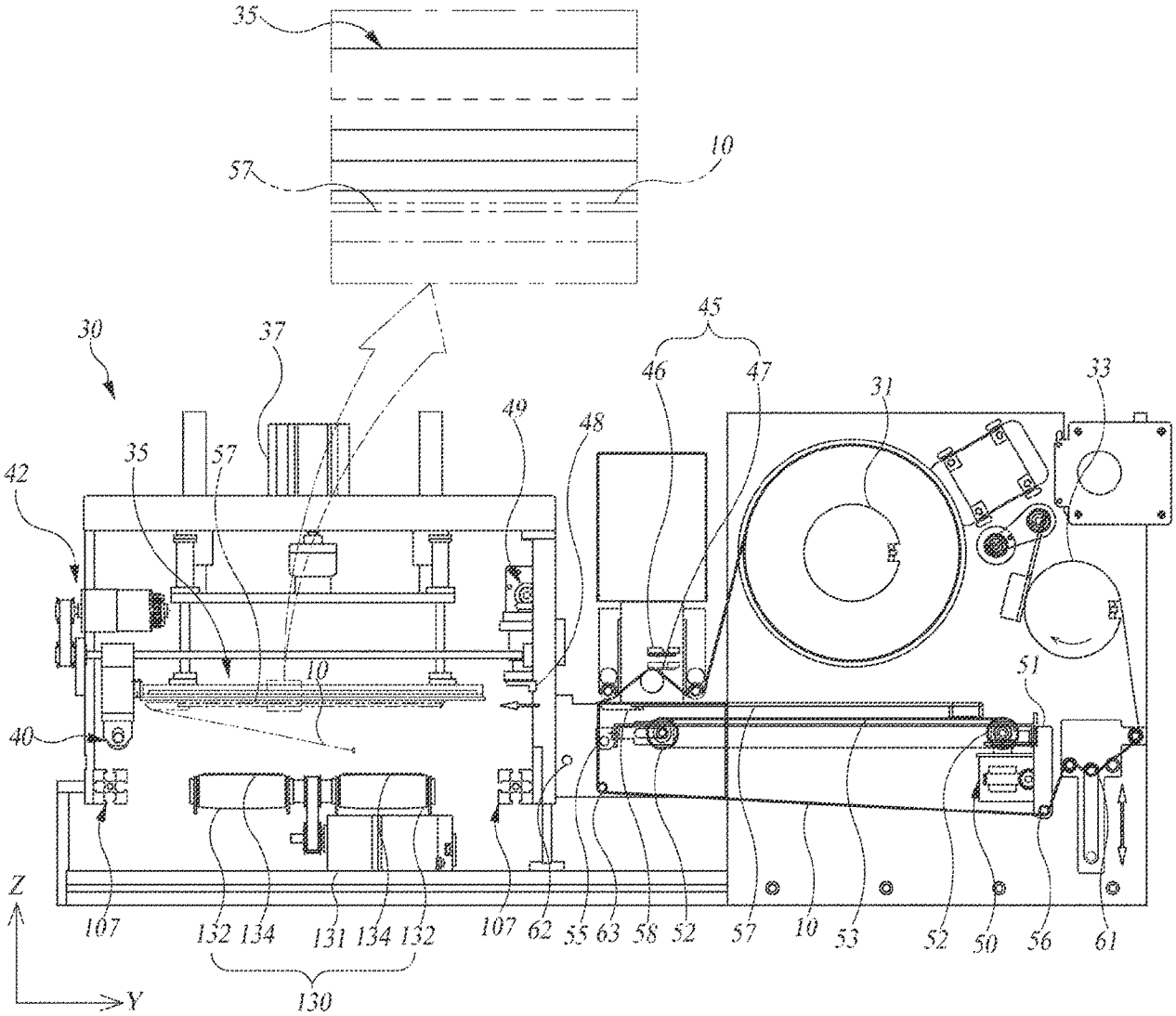
FIGS. 4 to 9 are views sequentially showing operation of the cover attaching unit for a blister pack provided in the blister packing apparatus for drugs shown in FIG. 2.

In detail, the blister sheet feeding unit 100 includes a blister sheet tray 101, a tray driver 108, and a pair of guide rails 107 (refer to FIG. 4). One blister sheet 2 is seated on the blister sheet tray 101. The tray driver 108 moves the blister sheet tray 101 between the blister sheet supply unit 110, the drug dispensing unit 120, and the cover attaching unit 30 for a blister pack. The pair of guide rails 107 extends in a direction parallel to an X-axis in order to guide movement of the blister sheet tray 101.

Guide rollers 105 (refer to FIG. 7) are mounted on a front surface and a rear surface of the blister sheet tray 101. The guide rollers 105 are engaged with the guide rails 107 in order to guide movement of the blister sheet tray 101 in a direction parallel to the X-axis.

Figure 7:
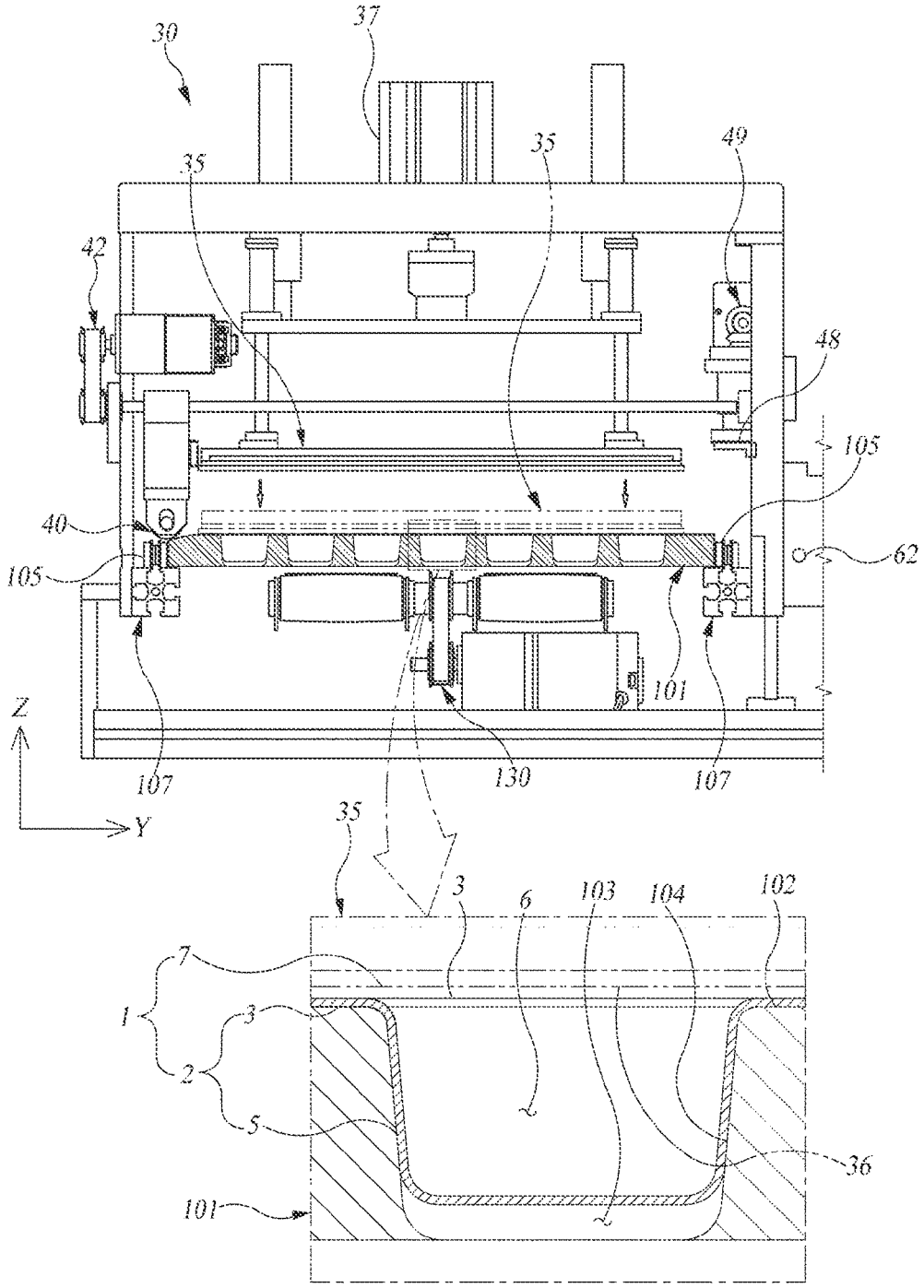

The blister sheet tray 101 includes a flat portion support surface 102 (refer to FIG. 7) and a plurality of pocket-portion-corresponding cavities 103 (refer to FIG. 7). The flat portion support surface 102 supports the flat portion 3 of the blister sheet 2. The plurality of pocket-portion-corresponding cavities is formed to allow the plurality of pocket portions 5 of the blister sheet 2, which protrude downward, to be fitted thereinto in one-to-one correspondence. Inner side surfaces 104 (refer to FIG. 7) of the pocket-portion-corresponding cavities 103 are formed to be tapered so that the pocket portions 5 protruding downward in a tapered manner are brought into surface contact therewith and supported thereby. Therefore, when the blister sheet tray 101 on which the blister sheet 2 is seated is moved at high speed, the blister sheet 2 is prevented from being separated from the blister sheet tray 101.

When the blister sheet 2 falling down from the blister sheet supply unit 110 is seated on the blister sheet tray 101 located below the blister sheet supply unit 110, the blister sheet tray 101 is moved to and stopped at a position below the drug dispensing unit 120. The drugs corresponding to the prescription fall down from the drug dispensing unit 120 at once, and are simultaneously received in the plurality of drug pockets 6.

When the blister sheet tray 101 on which the blister sheet 2, with the plurality of drug pockets 6 filled with the drugs, is seated is moved to and stopped at a position below the cover attaching unit 30 for a blister pack (refer to FIG. 7), the cover 7 is attached to the upper surface of the flat portion 3 of the blister sheet 2 to completely form the blister pack 1 (refer to FIG. 8). The blister pack 1 is lifted upward so as to be separated from the blister sheet tray 101 (refer to FIG. 9), and the blister sheet tray 101 separated from the blister pack 1 is moved back to a position at which a new blister sheet 2 having no drugs in the plurality of drug pockets 6 falls down to be seated on the blister sheet tray 101, that is, a position below the blister sheet supply unit 110.

The blister pack discharge conveyor 130 discharges the blister pack 1 completely formed by attaching the cover 7 to the blister sheet 2 to a loading position outside the housing 21 of the blister packing apparatus 20 for drugs, and is located between the pair of guide rails 107 at a position below a cover suction plate 35 of the cover attaching unit 30.

In detail, the blister pack discharge conveyor 130 includes a plurality of belt support rollers 132, a driving motor 131, and a conveyor belt 134. The plurality of belt support rollers 132 is spaced apart from each other in a direction parallel to the X-axis. The driving motor 131 provides power to rotate at least one of the plurality of belt support rollers 132. The conveyor belt 134 is disposed around the plurality of belt support rollers 132, and runs while circulating between the plurality of belt support rollers 132 when the motor shaft of the driving motor 131 rotates.

Figure 3:
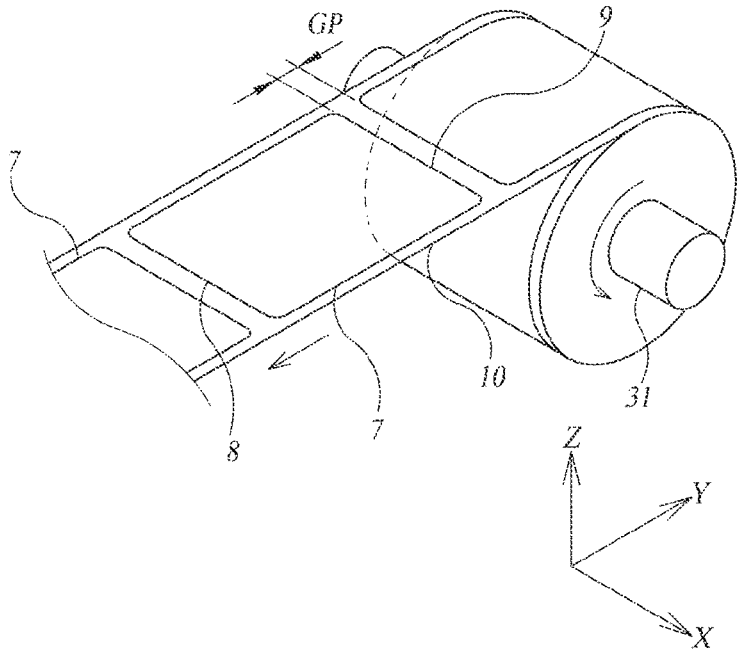
FIG. 3 is a perspective view showing a cover supplied through a cover supply roller of a cover attaching unit for a blister pack provided in the blister packing apparatus for drugs shown in FIG. 2.
Figure 5:
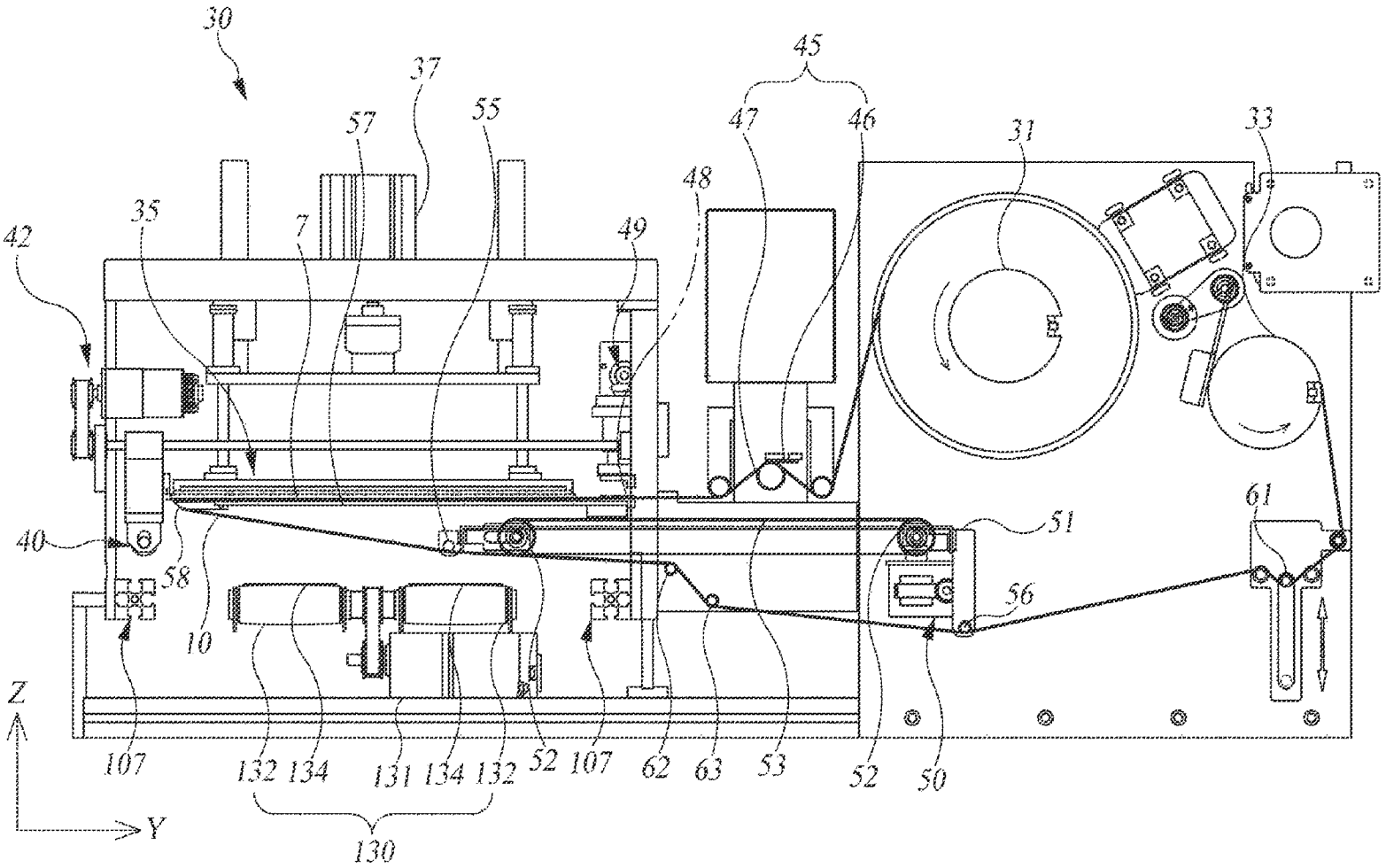

FIG. 3 is a perspective view showing a cover supplied through a cover supply roller of the cover attaching unit for a blister pack provided in the blister packing apparatus for drugs shown in FIG. 2. FIGS. 4 to 9 are views sequentially showing operation of the cover attaching unit for a blister pack provided in the blister packing apparatus for drugs shown in FIG. 2. Referring to FIGS. 3 to 5 together, the cover attaching unit 30 for a blister pack includes a cover supply roller 31, a release film collecting roller 33, a cover suction plate 35, a cover separating plate 57, a separating plate driver 50, a cover separating plate locker 48, a printer 45, and a cover pressing roller 40.

The cover supply roller 31 is a roller that continuously supplies a release film 10 to which the cover 7 is detachably attached so that the lower surface of the cover 7 to which an adhesive is applied is not exposed, and is disposed behind the cover suction plate 35. A plurality of covers 7 is attached to the release film 10 and is arranged in a line so as to be spaced apart from each other at a regular interval GP between a rear end 9 of a preceding cover 7 and a front end 8 of a following cover 7. The release film collecting roller 33 is a roller that collects the release film 10 from which the cover 7 has been separated by winding the same thereon, and is disposed behind the cover suction plate 35. The drug dispensing unit 120 and the blister sheet supply unit 110 are disposed on the left side of the cover suction plate 35 of the cover supply unit 30, and the cover supply roller 31 and the release film collecting roller 33 are disposed behind the cover suction plate 35. Therefore, the blister packing apparatus 20 for drugs may be designed to have a compact width in a leftward-rightward direction.

The cover suction plate 35 is a plate-shaped mechanism that vacuum-sucks the cover 7, and is capable of being moved up and down by driving force of a pneumatic cylinder (air cylinder) 37. The lower surface of the cover suction plate 37 is a suction surface 36 (refer to FIG. 6) that vacuum-sucks the cover 7. The cover separating plate 57 is a plate-shaped mechanism that separates the cover 7 attached to and supported on the release film 10 supplied from the cover supply roller 31 from the release film 10, and is movable between a first position that does not overlap the cover suction plate 37 and a second position that overlaps the cover suction plate 37. The cover separating plate 57 located at the first position is shown as a solid line in FIG. 4, and the cover separating plate 57 located at the second position is shown as a solid line in FIG. 5. As shown in FIG. 4, when located at the first position, the cover separating plate 57 is located behind the cover suction plate 37. As shown in FIG. 5, when located at the second position, the cover separating plate 57 is located below the cover suction plate 37 so as to overlap the cover suction plate 37.

Figure 6:
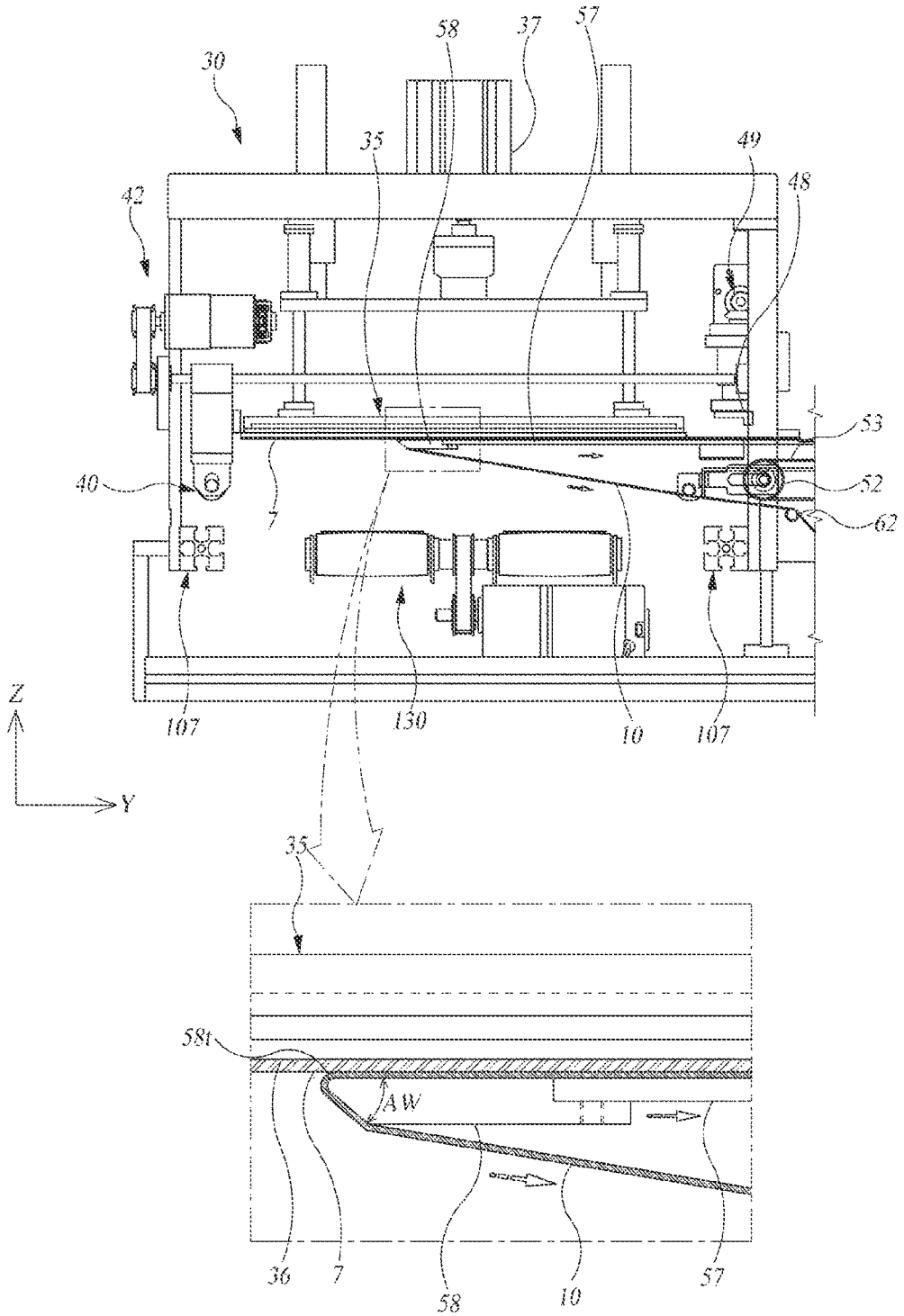

Referring to FIG. 6, the cover separating plate 57 is provided at a front end thereof with a wedge 58. The wedge 58 bends the travel direction of the release film 10 at an acute angle AW so that the cover 7 is separated from the release film 10. As shown in FIG. 6, the travel direction of the release film 10 having the cover 7 attached thereto and supported thereon is switched to be opposite that of the cover 7 by an edge 58*t* protruding from a distal end of the wedge 58 at the acute angle AW, with a result that the cover 7 is separated from the release film 10.

Referring again to FIGS. 3 to 5, the separating plate driver 50 is a mechanism that reciprocates the cover separating plate 57 in a direction parallel to the Y-axis, and includes a pair of belt support rollers 52 spaced apart from each other in a direction parallel to the Y-axis, a driving motor (not shown) configured to provide power to rotate at least one of the pair of belt support rollers 52, and a separating plate fixing belt 53 disposed around the pair of belt support rollers 52 to fix and support the rear end portion of the cover separating plate 57. According to the rotating direction of the motor shaft of the driving motor, when the pair of belt support rollers 52 rotates in the counterclockwise direction, the cover separating plate 57 may move forward in a direction parallel to the negative (−) Y-axis direction, or when the pair of belt support rollers 52 rotates in the clockwise direction, the cover separating plate 57 may move backward in a direction parallel to the positive (+) Y-axis direction.

The separating plate driver 50 is capable of moving by itself in a direction parallel to the direction in which the cover separating plate 57 is moved, i.e. a direction parallel to the Y-axis, in order to increase the distance between the first position and the second position of the cover separating plate 57 while minimizing the gap between the pair of belt support rollers 52. In detail, the pair of belt support rollers 52 and the driving motor are supported by a bracket 51, and the bracket 51 is movable between a backward position (refer to FIG. 4) close to the release film collecting roller 33 and a forward position (refer to FIG. 5) farther away from the release film collecting roller 33 than the backward position. Illustration of a driving means for moving the bracket 51 in a direction parallel to the Y-axis is omitted in FIGS. 4 and 5.

As shown in FIG. 4, when the cover separating plate 57 is located at the first position, the bracket 51 of the separating plate driver 50 is moved backward so as not to overlap vertically the cover suction plate 35, and the rear end portion of the cover separating plate 57 is located closer to a rear belt support roller among the pair of belt support rollers 52. On the other hand, as shown in FIG. 5, when the cover separating plate 57 is located at the second position, the front end portion of the bracket 51 of the separating plate driver 50 and a front belt support roller among the pair of belt support rollers 52 are moved forward so as to overlap vertically the cover suction plate 35. The bracket 51 is provided on the front end and the rear end thereof with first and second position movement guide rollers 55 and 56 that guide the travel route of the release film 10 pulled and collected by the release film collecting roller 33.

Meanwhile, reference numerals 62 and 63 denote first and second position fixing guide rollers that guide the travel route of the release film 10 pulled and collected by the release film collecting roller 33 and are supported by the frame of the cover attaching unit 30 so as not to move forward or backward, and reference numeral 61 denotes a tension roller that maintains proper tension of the release film 10 pulled and collected by the release film collecting roller 33.

The cover separating plate locker 48 blocks the rear end portion of the cover separating plate 57 so that the cover separating plate 57 located at the second position is not moved toward the first position by the tension of the release film 10 pulled and collected by the release film collecting roller 33, in other words, so that the cover separating plate 57 is not moved backward parallel to the positive (+) Y-axis direction. In detail, the cover separating plate locker 48 is provided in a pair in order to block the left rear end portion and the right rear end portion of the cover separating plate 57 in a direction parallel to the X-axis. The pair of cover separating plate lockers 48 may be spaced apart from each other by an interval greater than or equal to the width of the release film 10, and the release film 10 having the cover 7 attached thereto may be supplied to a region between the pair of spaced cover separating plate lockers 48 from the cover supply roller 31 and may move forward toward the wedge 58.

The pair of cover separating plate lockers 48 is moved up and down between a locking position and an unlocking position by driving force of a locker lifting driver 49. Before the cover separating plate 57 moves from the first position to the second position, the locker lifting driver 49 moves the pair of cover separating plate lockers 48 up from the locking position to the unlocking position, thereby unlocking the position of the cover separating plate 57.

The printer 45 prints letters or pictures on the upper surface of the cover 7 supplied from the cover supply roller 31. The cover 7 may be thermal paper. The printer 45 includes a printer head 46 and a printing support roller 47. The printer head 46 prints letters or pictures on the cover 7 through a thermal printing method. When the printer head 46 prints letters or pictures on the cover 7, the printing support roller 47 supports the cover 7 so that the cover 7 tightly contacts the printer head 46. The printer head 46 may move down toward the cover 7 supported by the printing support roller 47 or may move up away from the cover 7. The printer 45 performs printing on the cover 7 while the cover 7 attached to the release film 10 is moved to a position below the cover suction plate 35 so as to be aligned with the cover suction plate 35 by rotation of the cover supply roller 31 in the supply direction of the release film 10 having the cover 7 attached thereto, i.e. the counterclockwise direction based on FIG. 5.

As shown in FIG. 7, the cover suction plate 35 moves down in a state in which the cover 7 separated from the release film 10 is sucked by the cover suction plate 35. Then, the cover 7 is attached to the blister sheet 2 seated on the blister sheet tray 101 while the blister sheet 2 stays below the cover suction plate 35. After the lower surface of the cover 7 is attached to the blister sheet 2, the cover suction plate 35 stops vacuum-sucking the cover 7, and moves up. The cover pressing roller 40 presses the cover 7 attached to the blister sheet 2 toward the blister sheet 2 so that the cover 7 is adhesively fixed to the blister sheet 2.

Figure 8:
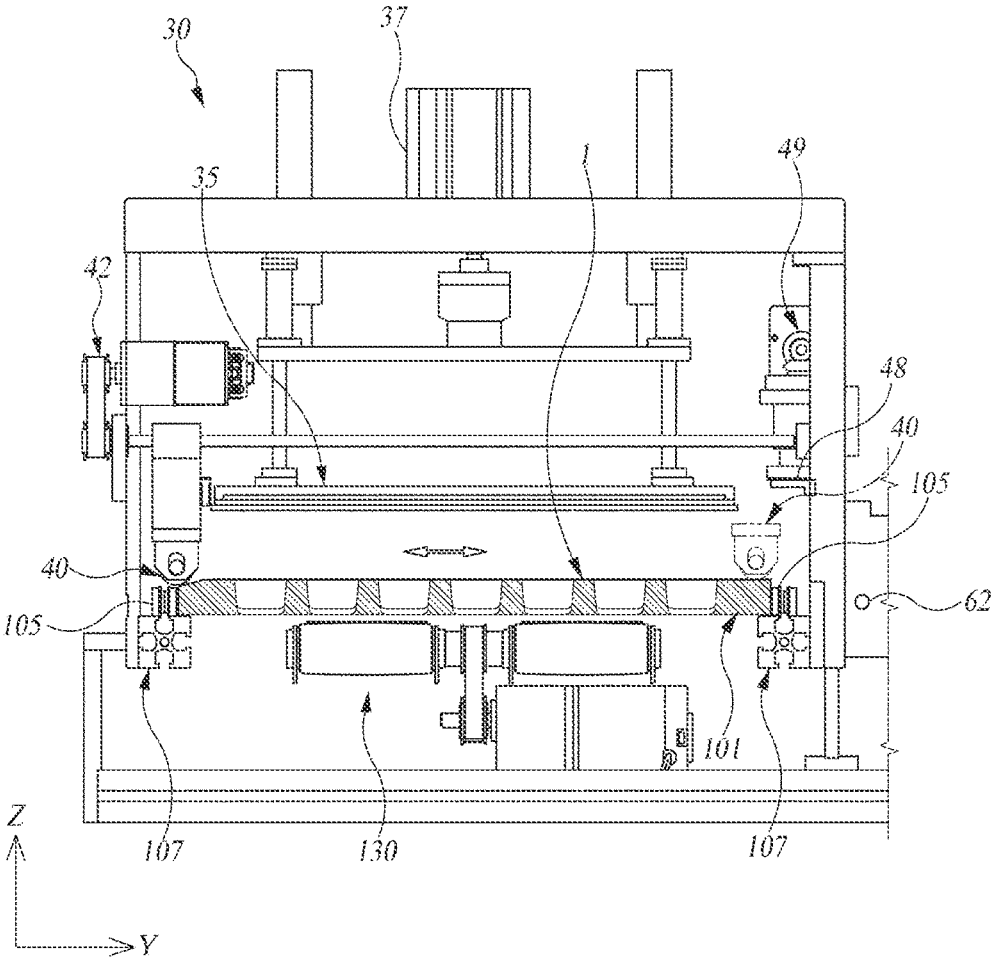

In detail, as shown in FIG. 8, the cover pressing roller 40 reciprocates back and forth while pressing the cover 7 attached to the blister sheet 2 downward, with a result that the cover 7 attached to the blister sheet 2 is firmly adhesively fixed to the blister sheet 2. Reference numeral 42 denotes a cover pressing roller driver that provides power to reciprocate the cover pressing roller 40 back and forth.

Hereinafter, the operation and structure of the cover attaching unit 30 for a blister pack and the blister packing apparatus 20 for drugs (refer to FIG. 2) will be described in more detail with sequential reference to FIGS. 4 to 9. Referring to FIG. 4, the cover separating plate 57 is located at the first position. In this case, the release film 10 has no cover 7 attached thereto in a section between the wedge 58 of the cover separating plate 57 and the release film collecting roller 33, but has the cover 7 attached thereto in a section between the wedge 58 and the cover supply roller 31.

Subsequently, as shown in FIGS. 4 and 5, the cover separating plate 57 moves from the first position to the second position. In order to prevent the tension of the release film 10 from becoming excessive when the cover separating plate 57 moves from the first position to the second position, the release film collecting roller 33 rotates in a direction opposite the direction in which the release film 10 is wound to be collected, and the cover supply roller 31 does not rotate. The rotating direction of the release film collecting roller 33 indicated by an arrow in FIG. 4 is the reverse rotating direction of the release film collecting roller 33. If the release film collecting roller 33 rotates in the direction in which the release film 10 is wound to be collected, i.e. the forward direction, the cover separating plate 57 may not move from the first position to the second position, or the release film 10 may break due to excessive tension. As shown in FIG. 4, when the cover separating plate 57 is located at the first position, the release film 10 is not supported by the first position movement guide roller 55. However, as shown in FIG. 5, when the cover separating plate 57 is located at the second position, the release film 10 is supported by the first position movement guide roller 55.

The cover supply roller 31 may be an idling roller that is not rotated by power supplied from a motor, but by force by which the release film 10 is pulled. As described above, since the release film 10 is not pulled while the release film collecting roller 33 rotates in the reverse direction, the cover supply roller 31 does not rotate in the direction in which the release film 10 is supplied. Therefore, while the cover separating plate 57 moves forward from the first position to the second position, the cover 7 attached to the release film 10 is not supplied from the cover supply roller 31.

Referring to FIG. 5, when the cover separating plate 57 is located at the second position, the cover separating plate locker 48 moves down from the unlocking position to the locking position to fix the position of the cover separating plate 57 so that the cover separating plate 57 does not move backward toward the first position. Thereafter, the release film collecting roller 33 rotates in the direction in which the release film 10 is wound to be collected, i.e. the forward direction indicated by an arrow in FIG. 5. Accordingly, the release film 10 is pulled, and thus the cover supply roller 33 rotates in the direction in which the release film is supplied, i.e. the forward direction indicated by the arrow in FIG. 5, with a result that the cover 7 attached to the release film 10 moves forward to a position below the cover suction plate 35 so as to be aligned with the cover suction plate 35. While the cover 7 attached to the release film 10 is released from the cover supply roller 31 and moves forward to a position below the cover suction plate 35, the printer 45 prints letters or pictures on the cover 7, as described above.

Although not shown in the drawings, the cover suction plate 35 may be provided with a cover detection sensor that detects whether the cover 7 attached to the release film 10 has reached a position below the cover suction plate 35 so as to be aligned with the cover suction plate 35. The cover detection sensor may be an optical sensor that detects the front end 8 or the rear end 9 of the cover 7 or a specific sign printed on the cover 7 in a non-contact manner. When the cover 7 attached to the release film 10 is detected by the cover detection sensor, the rotation of the release film collecting roller 33 for winding and collection of the release film 10 is stopped.

After the cover separating plate 57 is located at the second position and the cover 7 attached to the release film 10 is located below the cover suction plate 35 so as to be aligned with the cover suction plate 35, the suction surface 36 (refer to FIG. 6) of the cover suction plate 35 vacuum-sucks the cover 7. Subsequently, the cover separating plate locker 48 moves up from the locking position to the unlocking position. As shown in FIG. 6, the cover separating plate 57 moves backward from the second position to the first position, and at the same time, the release film collecting roller 33 (refer to FIG. 4) winds the release film 10 to collect the same, with a result that the release film 10 is separated from the cover 7 sucked by the suction surface 36 while running backward after being bent by the edge 58*t* of the wedge 58. In other words, the cover 7 sucked by the suction surface 36 is separated from the release film 10.

As shown in FIG. 7, after the cover separating plate 57 completely returns to the first position, the blister sheet 2 seated on the blister sheet tray 101 moves to a position below the cover suction plate 35 so as to be vertically aligned with the cover suction plate 35. In detail, the blister sheet tray 101 on which the blister sheet 2, with the plurality of drug pockets 6 filled with the drugs falling down from the drug dispensing unit 120, is seated and supported moves from the drug dispensing unit 120 to a position below the cover suction plate 35 before the cover suction plate 35 moves down in a state of sucking the cover 7. Subsequently, as shown by an alternate long and two short dashes line in FIG. 7, the cover suction plate 35 sucking the cover 7 moves down, and the lower surface of the cover 7 is attached to the flat portion 3 of the blister sheet 2.

Referring to FIG. 8, after the lower surface of the cover 7 is attached to the blister sheet 2, the cover suction plate 35 stops vacuum-sucking the cover 7, and moves up. Subsequently, as described above, the cover pressing roller 40 reciprocates back and forth while pressing the cover 7 attached to the blister sheet 2 downward so that the cover 7 attached to the blister sheet 2 is firmly adhesively fixed to the blister sheet 2. Subsequently, the cover suction plate 35 moves down again to again vacuum-suck the cover 7 adhesively fixed to the blister sheet 2, and then moves up again. Accordingly, the blister pack 1 is lifted up and is separated from the blister sheet tray 101.

Figure 9:
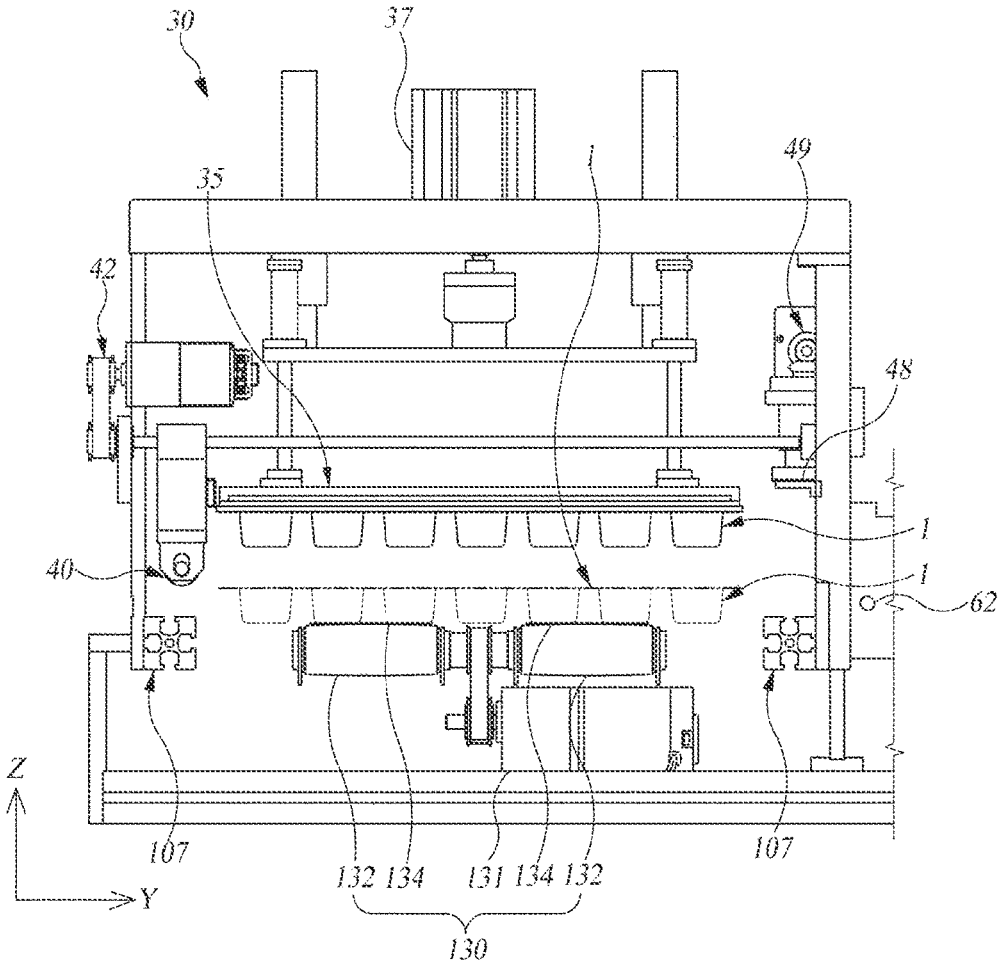

As shown in FIG. 9, the blister sheet tray 101 from which the blister pack 1 has been separated moves parallel to the negative (−) X-axis direction to the blister sheet supply unit 110. Accordingly, the blister sheet tray 101 is removed from a position below the cover suction plate 35, and the conveyor belt 134 of the blister pack discharge conveyor 130 is exposed.

Subsequently, as shown by an alternate long and two short dashes line in FIG. 9, the cover suction plate 35 moves down again in a state of sucking the blister pack 1 to place the blister pack 1 on the conveyor belt 134 of the blister pack discharge conveyor 130. Subsequently, the cover suction plate 35 again stops vacuum sucking, moves up to the original position thereof, and the conveyor belt 134 of the blister pack discharge conveyor 130 circulates to move the blister pack 1 to a predetermined loading position outside the housing 21.

The cover attaching unit 30 for a blister pack described above automatically attaches the cover 7 to the blister sheet 2 into which drugs are introduced according to a prescription, thereby completely forming the blister pack 1 containing the drugs. Therefore, the efficiency and reliability of an automatic drug packaging process using the blister sheet 2 are improved. Since the cover attaching unit 30 for a blister pack includes the cover separating plate 57 configured to be movable to a position overlapping the cover suction plate 35, the cover 7 is sucked by the cover suction plate 35 in a state of being accurately spread and aligned with the cover suction plate 35. Therefore, no error or quality defect occurs in the cover attaching process. In addition, the cover attaching unit 30 for a blister pack prints information for identifying drugs and a recipient of the drugs and information about a drug-taking procedure on the cover 7 using the printer 45, thereby preventing the occurrence of errors in transferring the blister pack 1 and assisting in correct dosing of drugs.

Although the present invention has been described with reference to embodiments illustrated in the drawings, it is to be understood that the embodiments are merely exemplary and various modifications or equivalent embodiments thereof may be made from the detailed description of the present invention by those skilled in the art. Therefore, the true scope of protection of the present invention should be determined only by the appended claims.

The present invention may be used in the fields of separating and packaging prepared drugs, such as in pharmacies, hospitals, senior living communities, and drug packaging companies.

The invention claimed is:

1. A cover attaching unit for a blister pack configured to attach a cover having an adhesive applied to a lower surface thereof to a blister sheet comprising a plurality of drug pockets to close the plurality of drug pockets, the cover attaching unit comprising:

a cover supply roller configured to supply a release film having the cover detachably attached thereto so that the lower surface of the cover is not exposed;

a release film collecting roller configured to wind and collect the release film, with the cover separated therefrom;

a cover suction plate comprising a suction surface configured to suck the cover; and a cover separating plate configured to be movable between a first position not overlapping the cover suction plate and a second position overlapping the cover suction plate and comprising a wedge to bend a travel direction of the release film at an acute angle so that the cover is separated from the release film, wherein, after the cover separating plate is located at the second position and the cover attached to the release film is located below the cover suction plate so as to be aligned with the cover suction plate, the suction surface of the cover suction plate sucks the cover, the cover separating plate moves to the first position, the release film collecting roller winds and collects the release film to separate the cover from the release film, the blister sheet moves to a position below the cover suction plate, and the cover suction plate sucking the cover moves down to attach the lower surface of the cover to the blister sheet.

2. The cover attaching unit according to claim 1, wherein, in order to prevent tension of the release film from becoming excessive when the cover separating plate moves from the first position to the second position, the release film collecting roller rotates in a direction opposite a direction in which the release film is wound to be collected, and the cover supply roller does not rotate.

3. The cover attaching unit according to claim 2, wherein, after the cover separating plate is located at the second position, the release film collecting roller rotates in the direction in which the release film is wound to be collected, the cover supply roller rotates in a direction in which the release film is supplied, and the cover attached to the release film moves to a position below the cover suction plate so as to be aligned with the cover suction plate.

4. The cover attaching unit according to claim 3, further comprising a printer configured to print letters or pictures on an upper surface of the cover, wherein the printer performs printing on the cover while the cover attached to the release film is moved to the position below the cover suction plate so as to be aligned with the cover suction plate by rotation of the cover supply roller in the direction in which the release film is supplied.

5. The cover attaching unit according to claim 3, further comprising a cover separating plate locker configured to block the cover separating plate so that the cover separating plate located at the second position is not moved toward the first position by tension of the release film, wherein the cover separating plate locker is configured to be movable between a locking position at which the cover separating plate locker blocks the cover separating plate to fix a position of the cover separating plate and an unlocking position at which the cover separating plate locker does not block the cover separating plate.

6. The cover attaching unit according to claim 1, further comprising a separating plate driver configured to move the cover separating plate, wherein the separating plate driver moves by itself in a direction parallel to a direction in which the cover separating plate is moved in order to increase a distance between the first position and the second position.

7. The cover attaching unit according to claim 1, wherein, after the lower surface of the cover is attached to the blister sheet, the cover suction plate stops sucking the cover and moves up, and wherein the cover attaching unit further comprises a cover pressing roller configured to press the cover attached to the blister sheet toward the blister sheet so that the cover is adhesively fixed to the blister sheet.

8. A blister packing apparatus for drugs, the blister packing apparatus comprising:

a drug dispensing unit configured to dispense and drop drugs prepared in a unit dose according to a prescription to each of a plurality of drug pockets formed in a blister sheet;

a drug supply unit disposed above the drug dispensing unit to drop drugs to the drug dispensing unit;

a blister sheet supply unit configured to drop and supply a blister sheet having no drugs in the plurality of drug pockets one by one;

the cover attaching unit according to claim 1, the cover attaching unit being configured to attach a cover to the blister sheet, with the plurality of drug pockets filled with the drugs, to form a blister pack having the plurality of closed drug pockets; and a blister sheet feeding unit configured to feed the blister sheet falling down from the blister sheet supply unit to the drug dispensing unit and to feed the blister sheet, with the plurality of drug pockets filled with the drugs, from the drug dispensing unit to the cover attaching unit.

9. The blister packing apparatus according to claim 8, wherein the blister sheet moves from the drug dispensing unit to a position below the cover suction plate before the cover suction plate moves down in a state of sucking the cover.

10. The blister packing apparatus according to claim 8, further comprising a blister pack discharge conveyor configured to discharge the blister pack outside of the blister packing apparatus.

11. The blister packing apparatus according to claim 10, wherein the blister sheet feeding unit comprises:

a blister sheet tray configured to allow the blister sheet to be seated thereon;

a tray driver configured to move the blister sheet tray between the blister sheet supply unit, the drug dispensing unit, and the cover attaching unit; and a pair of guide rails extending parallel in order to guide movement of the blister sheet tray, wherein the blister pack discharge conveyor is located between the pair of guide rails at a position below the cover suction plate, and wherein the cover suction plate sucks the blister pack and moves up so that the blister pack is lifted up so as to be separated from the blister sheet tray, the blister sheet tray, with the blister pack separated therefrom, moves to the blister sheet supply unit, the cover suction plate moves down again to place the blister pack on the blister pack discharge conveyor, the cover suction plate stops sucking and moves up again, and the blister pack discharge conveyor moves the blister pack.

12. The blister packing apparatus according to claim 8, wherein the drug dispensing unit is disposed on a left side or a right side of the cover suction plate, wherein the cover supply roller and the release film collecting roller are disposed behind the cover suction plate, and wherein, when the cover separating plate is located at the first position, the cover separating plate is located behind the cover suction plate, and when the cover separating plate is located at the second position, the cover separating plate is located below the cover suction plate.

* * * * *